US005120025A

United States Patent [19]

D'Avanzo

[11] Patent Number: 5,120,025

[45] Date of Patent: Jun. 9, 1992

[54] PICKET FENCE JOINT

[75] Inventor: Battista D'Avanzo, Mississauga, Canada

[73] Assignee: Kafko International, Inc., Mississauga, Canada

[21] Appl. No.: 603,813

[22] Filed: Oct. 22, 1990

[30] Foreign Application Priority Data

Apr. 3, 1990 [CA] Canada ..... 2013693

[51] Int. Cl.[5] ..... E04H 17/14

[52] U.S. Cl. ..... 256/22; 256/72; 256/65

[58] Field of Search ..... 256/22, 21, 65, 67, 256/72; 403/263, 194

[56] References Cited

U.S. PATENT DOCUMENTS

| | | | |
|---|---|---|---|
| 2,218,954 | 10/1940 | Gustafson | 256/22 |
| 3,822,053 | 7/1974 | Daily | 256/21 X |
| 3,924,834 | 12/1975 | Young | 256/22 |
| 4,625,948 | 12/1986 | Lustvee | 256/22 X |
| 4,898,365 | 2/1990 | Conner et al. | 403/263 X |
| 5,002,260 | 3/1991 | Lustree | 250/65 X |

*Primary Examiner*—Peter M. Cuomo
*Attorney, Agent, or Firm*—Barry R. Lipsitz

[57] ABSTRACT

A method of assembling a fence is disclosed and a joint for attaching pickets to a horizontal rail in the fence. The horizontal rail has apertures formed therein through which the pickets slide. The apertures have projecting tongues which engage recesses formed in the pickets to form a joint to suspend the pickets in the rail. Rotation of the horizontal rail locks the pickets in place.

1 Claim, 2 Drawing Sheets

PICKET FENCE JOINT

This invention relates to metal fences, and in particular to joints for retaining pickets in horizontal rails in such fences.

Metal fences have been produced in the past where vertical pickets are attached to upper and lower horizontal rails, which are in turn mounted on upright, spaced-apart fence posts. One of the most common types of picket is a simple steel angle member, and such pickets are commonly attached to horizontal steel angle members or rails using conventional threaded fasteners. A difficulty with this type of fence is that the use of threaded fasteners for each picket makes the assembly of the fence very time consuming and thus expensive to install.

Attempts have been made to eliminate the threaded fasteners and an example of such a fence is shown in Canadian patent No. 1,232,481 issued to Kaljo Lustvee. This patent shows a fence with vertical pickets having pockets or loops and horizontal rails with vertical tabs or fingers which are inserted into the loops to retain the pickets in place. While this system works well, the fence is not as aesthetically pleasing as it might be.

BRIEF DESCRIPTION OF THE PREFERRED EMBODIMENT

In the present invention, the pickets are suspended in the rails using a tongue and recess joint, and when all of the pickets are in position, the rails are rotated to lock the pickets in place, making for a very fast and secure assembly.

According to one aspect of the invention, there is provided a fence construction comprising a first member having an aperture formed therein. The aperture has a peripheral edge portion defining an inwardly projecting tongue and an opposed back edge portion. A second member is dimensioned to slide loosely through the aperture, the second member having a transverse recess adapted to accommodate the first member tongue and restrain movement of the second member through the aperture.

Accordingly to another aspect of the invention, there is provided a method of assembling a fence having a plurality of vertical pickets extending through respective, spaced-apart apertures in a horizontal rail. The method comprises the steps of providing the rail with spaced-apart apertures having peripheral edge portions defining inwardly projecting tongues and opposed back edge portions. The apertures are dimensioned so that the pickets slide loosely therethrough in a transverse direction. Recesses are formed in selected picket walls to accommodate the tongues and suspend the pickets in the rail. A plurality of pickets are suspended on the tongues, and the rail is rotated so that the back edge portions engage the picket walls and prevent transverse movement of the pickets through the rail apertures.

BRIEF DESCRIPTION OF THE DRAWINGS

A preferred embodiment of the invention will now be described, by way of example, with reference to the accompanying drawings, in which.

Figure 1:
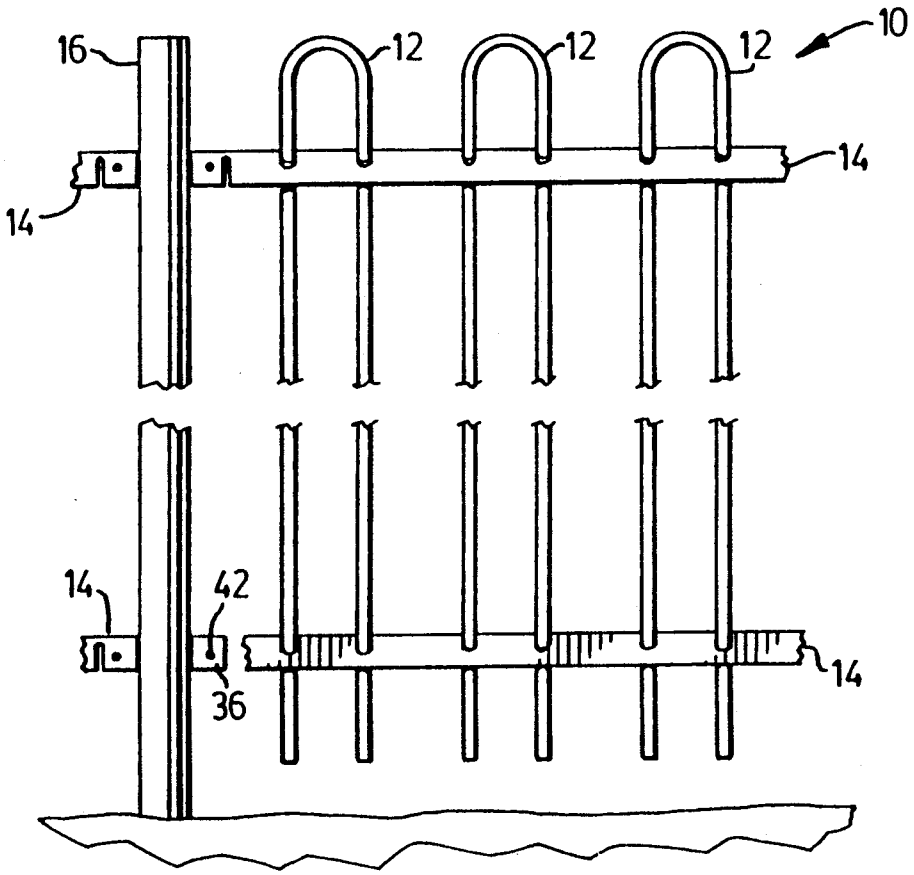
FIG. 1 is an elevational view for a preferred embodiment of a picket fence made in accordance with the present invention.

Referring firstly to FIG. 1, a preferred embodiment of a picket fence made in accordance with the present invention is generally indicated by reference numeral 10. Picket fence 10 includes a plurality of upright, inverted U-shaped pickets 12, spaced-apart, horizontal rails 14, and upright fence posts 16 only one of which is shown in FIG. 1. It will be appreciated that a fence post 16 would be located at each of the ends of rails 14 and the fence posts 16 would be spaced apart to accommodate a particular desired length of rails 14 and number of pickets 12.

Figure 4:
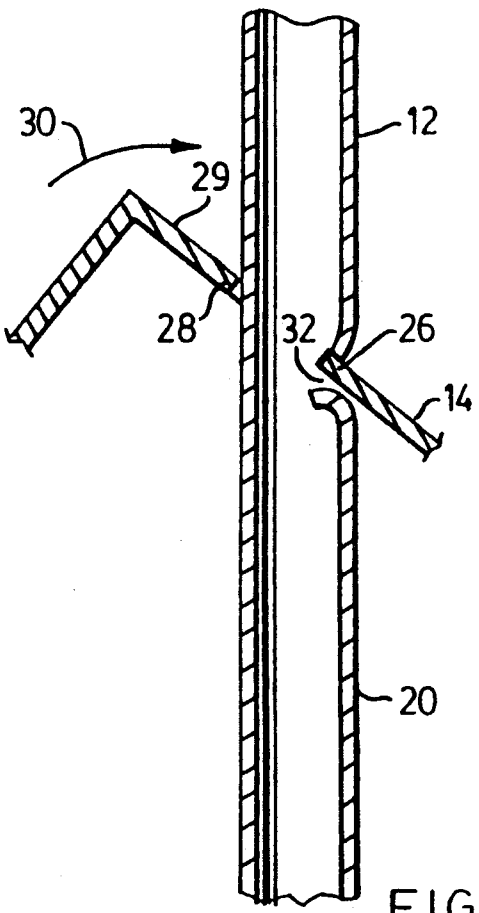
FIG. 4 is a vertical sectional view taken along lines 4—4 of FIG. 3.
Figure 3:
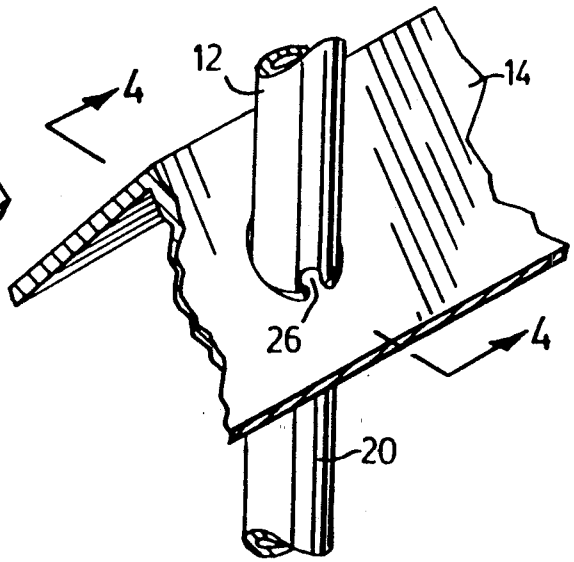
FIG. 3 is a perspective view of the picket to rail joint showing the rail rotated to lock the picket in place.
Figure 2:
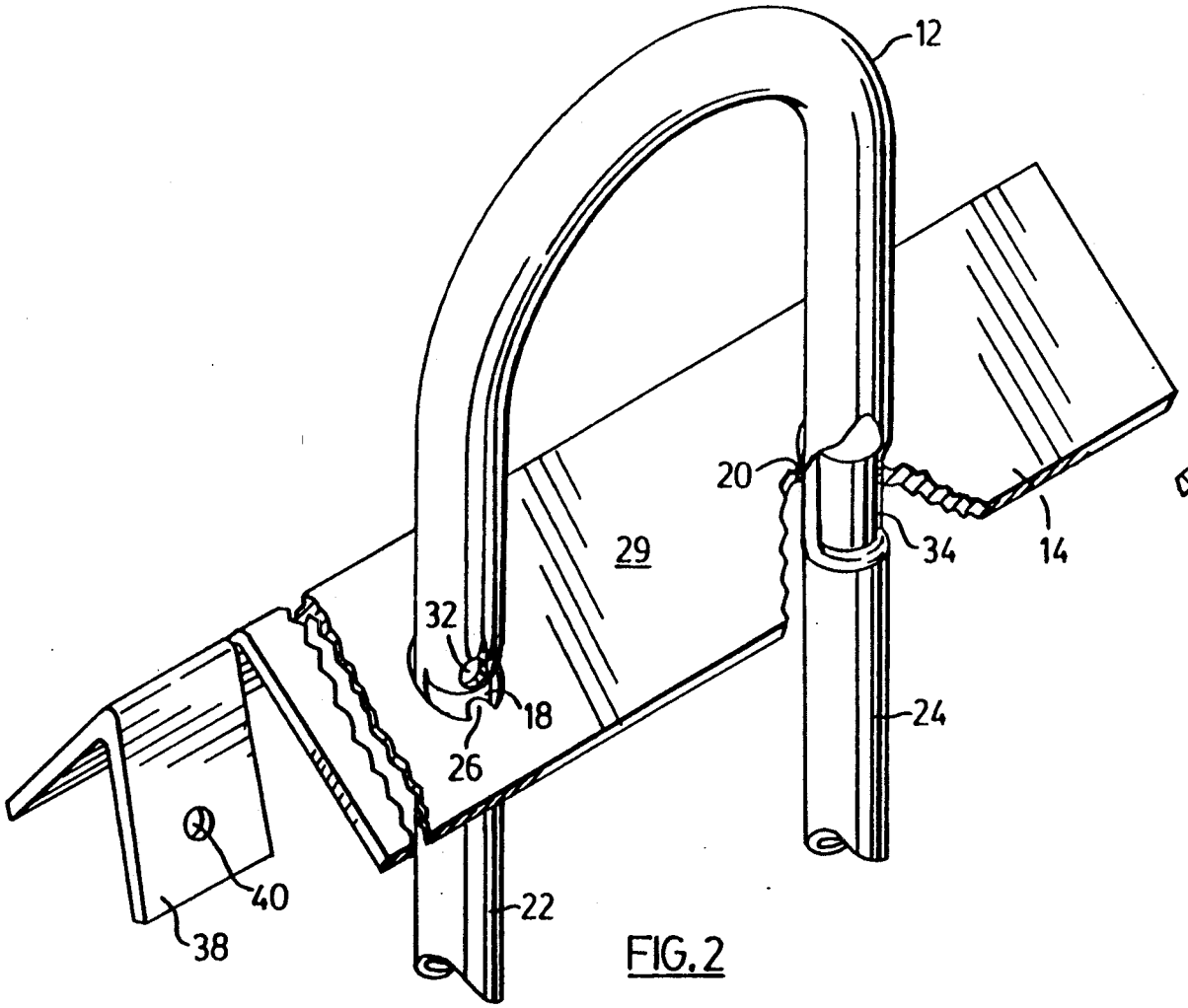
FIG. 2 is a perspective view of the picket to rail joint prior to the picket being locked into position.

Referring next to FIGS. 2, 3 and 4, the joint or connection between pickets 12 and rails 14 will now be described in detail. Rail 14 is a first member and has a plurality of apertures 18, 20 formed therein to accommodate second members which are the vertical tubular portions 22, 24 of picket 12. Apertures 18 have peripheral edge portions defining inwardly projecting tongues 26 and opposed back edge portions 28 (see FIG. 4).

Apertures 18, 20 are oblong in shape having opposed narrow ends, the tongues 26 on apertures 18 being located at one narrow end and the back edge portions 28 of apertures 18 being located at the opposite narrow end. The part of rail 14 containing apertures 18, 20 is a flat steel plate portion 29, and the apertures 18, 20 are dimensioned such that when this flat steel plate portion 29 is perpendicular to the picket tubular portions 22, 24, these tubular portions slide loosely through apertures 18, 20. When rail 14 is rotated in the direction of arrow 30 as seen in FIG. 4, the back edge portions 28 engage the picket walls to prevent transverse movement of pickets 12 through the rail apertures.

As seen best in FIG. 2, the vertical tubular portions 22 have transverse recesses or holes 32 to accommodate tongues 26. When flat plate portions 29 are perpendicular to vertical tubular portions 22 of pickets 12, these vertical tubular portions 22 can slide past tongues 26, and when recesses 32 are in registration with tongues 26, the tubular portions 22 can be moved toward tongues 26 to make tongues 26 enter recesses 32 and hang or suspend the pickets 12 in rail 14. When rail 14 is rotated in the direction of arrow 30 as seen in FIG. 4, tongues 26 are retained in recesses 30 to lock the pickets 12 in position relative to rails 14.

For each picket 12, it is only necessary that one of the vertical tubular portions 22, 24 has a recess 32 and that there be only one tongue 26 associated with that recess. As seen best in FIG. 1, two spaced-apart horizontal rails 14 are provided between each pair of fence posts, and the apertures in these rails are in registration to maintain pickets 12 in a vertical orientation. Accordingly, it is only necessary that there be one tongue 26 and associated recess 32 to keep pickets 12 from sliding downwardly through rails 14. As seen best in FIG. 2, vertical tubular portions 22 are recessed or necked just below recess 32. This is for aesthetic purposes as it allows the peripheral edge portion of aperture 18 to snugly enclose or surround the tubular portion when rail 14 is rotated into the locking position. Vertical tubular portion 24 also has a recessed or necked portion 34, but this necked portion 34 is elongated considerably to provide for some vertical misalignment of pickets 12.

It will be appreciated that the location of recesses 32 and necked portions 34 on each picket 12 determines the vertical height of picket 12 relative to rails 14. FIG. 1 shows all of the pickets 12 at the same height and in alignment, but the height of pickets 12 could be varied as desired for aesthetic reasons.

To assemble fence 10, a plurality of spaced-apart upright fence posts 16 would be erected in a conventional manner. Fence posts 16 have vertical plates or tabs 36 projecting outwardly therefrom on which rails 14 are supported. Rails 14 being steel angles or inverted V-shaped in cross section are simply laid on top of tabs 36, so that they can rock or pivot transversely. The rails 14 thus supported are rotated so that flat plate portions 29 are approximately horizontal and pickets 12 are slid down through apertures 18, 20. Each picket is suspended on an associated tongue 26. When all the pickets are in place, rails 14 are rotated in the direction of arrow 30 as seen in FIG. 4 to lock the pickets in place. Each end of rails 14 is provided with a tab 38 that engages tab 36 on post 16, and an appropriate threaded fastener (not shown) is passed through holes 40, 42 in respective tabs 38, 36 to attach rails 14 to posts 16 and retain the whole assembly together.

Having described preferred embodiments of the invention, it will be appreciated that various modifications may be made to the structure described. As mentioned above, instead of double or loop top pickets, single pickets could be used, each one having a recess 32 and each associated aperture having a tongue 26. Pickets 12 are shown having tubular vertical portions, but these could be solid members or have any other cross-sectional shape, such as flat plate or bar section.

Fence 10 is shown with vertical pickets and horizontal rails, but it will be appreciated that the fence could be rotated 90 degrees, so that pickets 12 are horizontal and rails 14 are vertical if desired. Any number of rails 14 and any number of pickets 12 could be used as desired.

From the above, it will be appreciated that the fence construction of the present invention is very fast and easy to assemble, and yet the structure is solid and secure. Further, the pickets cannot be removed unless the rails are unfastened from the fence posts.

What is claimed is:

1. A fence construction comprising: a first member having an elongate flat plate portion defining an oblong aperture having opposed narrow ends, the aperture having a peripheral edge portion defining an inwardly projecting tongue at one narrow end and an opposed back edge portion at the opposite narrow end; a second member dimensioned to slide loosely through the aperture, the second member having a transverse recess adapted to accommodate said first member tongue, the aperture being dimensioned such that transverse rotation of the plate portion causes the back edge portion to engage the second member and retain the tongue in the second member recess.

* * * * *